US009341336B2

(12) United States Patent
Koizumi

(10) Patent No.: US 9,341,336 B2
(45) Date of Patent: May 17, 2016

(54) VEHICLE HEADLAMP

(75) Inventor: Hiroya Koizumi, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 717 days.

(21) Appl. No.: 13/540,753

(22) Filed: Jul. 3, 2012

(65) Prior Publication Data

US 2013/0010488 A1 Jan. 10, 2013

(30) Foreign Application Priority Data

Jul. 5, 2011 (JP) ..... 2011-149512

(51) Int. Cl.
*F21S 8/10* (2006.01)

(52) U.S. Cl.
CPC ..... *F21S 48/1154* (2013.01); *F21S 48/1159* (2013.01); *F21S 48/1241* (2013.01); *F21S 48/1258* (2013.01); *F21S 48/1388* (2013.01)

(58) Field of Classification Search
CPC ..... F21V 7/0016; F21S 8/10; F21S 48/1154; F21S 48/1159; F21S 48/1241; F21S 48/1258; F21S 48/1388
USPC ..... 362/545, 507, 516, 521
See application file for complete search history.

(56) References Cited

U.S. PATENT DOCUMENTS

| | | | | |
|---|---|---|---|---|
| 6,578,997 | B2 * | 6/2003 | Futami | 362/522 |
| 7,311,430 | B2 * | 12/2007 | Tsukamoto et al. | 362/545 |
| 7,325,954 | B2 * | 2/2008 | Futami | 362/538 |
| 2008/0285297 | A1 | 11/2008 | Ishida | |

FOREIGN PATENT DOCUMENTS

| | | | |
|---|---|---|---|
| JP | 2008-288010 | A | 11/2008 |
| JP | 2009158386 | A | 7/2009 |
| JP | 2013-016327 | A | 1/2013 |

OTHER PUBLICATIONS

English Patent Abstract of JP 2009-158386. Publication Date: Jul. 16, 2009 (1 Page).
Notification of Reasons for Refusal issued in corresponding Japanese Application No. 2011-149512, mailed on Mar. 3, 2015 (6 pages).

* cited by examiner

*Primary Examiner* — Sharon Payne
(74) *Attorney, Agent, or Firm* — Osha Liang LLP

(57) ABSTRACT

A vehicle headlamp has a first light source disposed on a first optical axis that extends in a front-to-rear direction of a vehicle, a first lens that projects light emitted from the first light source to a front of the vehicle, a second lens having a rear focal point on a second optical axis that is parallel to the first optical axis and disposed adjacent to the first lens, a second light source disposed on the second optical axis rearwards of the first light source, a reflector that reflects light emitted from the second light source towards the rear focal point of the second lens, and a sub-reflector disposed such that the sub-reflector does not interfere with an optical path which extends from the reflector to the second lens and that causes part of light emitted from the first light source to be incident on the second lens.

4 Claims, 5 Drawing Sheets

VEHICLE HEADLAMP

CROSS-REFERENCE TO RELATED APPLICATIONS

The present application claims the benefit of priority of Japanese Patent Application No. 2011-149512, filed on Jul. 5, 2011, which is incorporated herein by reference.

BACKGROUND

1. Field of the Invention

The present invention relates mainly to a vehicle headlamp.

2. Related Art

There is known a daytime running lamp in which a headlamp is turned on in the daytime to enable the driver of an oncoming vehicle or a pedestrian to visually recognize the existence of the subject vehicle. Although normal headlamps may be turned on as daytime running lamps, there have been developed daytime running lamps which include an exclusive light source.

JP-A-2009-158386 discloses a vehicle headlamp which includes a headlamp light source and a daytime running lamp light source. In this vehicle headlamp, light from the headlamp light source is reflected to the front of a vehicle by a headlamp reflector, while light from the daytime running lamp light source is reflected to the front of the vehicle by the headlamp reflector by way of first and second daytime running lamp reflectors.

In the configuration described in JP-A-2009-158386, light acting as headlamp light and light acting as daytime running lamp light are reflected to the front of the vehicle by the same headlamp reflector. Because of this, a luminous intensity distribution control according to the characteristics of the headlamp and the daytime running lamp may be difficult.

SUMMARY

One or more embodiments of the present invention provides a technique for a vehicle headlamp in which a light source of an auxiliary lamp such as a daytime running lamp (hereinafter, referred to as "DRL") or a clearance lamp (hereinafter, referred to as "CLL") and a light source of a headlamp are incorporated in a single unit in which technique an optical system for the auxiliary lamp and an optical system for a headlamp (hereinafter, referred to as "HL") are provided separately and a luminous intensity distribution control is enabled to be performed on each of the auxiliary lamp optical system and the headlamp optical system.

According to one or more embodiments of the invention, there is provided a vehicle headlamp comprising a first light source which is disposed on a first optical axis which extends in a front-to-rear direction of a vehicle, a first lens which projects light emitted from the first light source to the front of the vehicle, a second lens having a rear focal point on a second optical axis which is parallel to the first optical axis and disposed adjacent to the first lens, a second light source which is disposed on the second optical axis in a position lying further rearwards of the vehicle than the first light source, a reflector which reflects light emitted from the second light source towards the rear focal point of the second lens, and a sub-reflector which is disposed in a position which does not interfere with an optical path which extends from the reflector to the second lens and which causes part of light emitted from the first light source to be incident on the second lens.

According to one or more embodiments of the present invention, the optical system for directing light emitted from the first light source which is used, for example, as a DRL or CLL light source towards the lens and the optical system for directing light emitted from the second light source which is used, for example, as a headlamp light source towards the lens are provided separately. Therefore, the luminous intensity distribution can be controlled so as to match each of the objects of the first light source and the second light source. Additionally, the light emitted from the first light source is shone to the front of the vehicle from both the first lens and the second lens, and therefore, the light emitting area when the first light source is illuminated can be expanded. In addition, the two types of lamps having the different objects can be integrated into the single unit, and therefore, it is possible not only to realize a reduction in cost but also to save space.

The sub-reflector may be disposed near to the rear focal point of the second lens. By so doing, reflected light from the sub-reflector is shone to a position lying near to an optical axis of the second lens, and therefore, an area lying near the horizontal center line can be illuminated brightly when the first light source is turned on.

An auxiliary reflection member may further be provided which reflects part of light emitted from the first light source towards the sub-reflector. By so doing, the amount of light which is guided to the second lens can be increased more than when light is caused to reach the second lens directly from the first light source. The auxiliary reflection member may be part of one of the other optical components or may be configured as a single optical component.

A shielding member may further be provided which conceals a gap defined between the first lens and the second lens. By so doing, the external appearance of the vehicle headlamp can be improved by making the internal construction of the headlamp such as the auxiliary reflection member invisible from the outside thereof.

According to one or more embodiments of the invention, in the vehicle headlamp which is configured so as to incorporate the light source of the auxiliary lamp such as DRL or CLL and the light source of the headlamp in the single unit, the luminous intensity distribution control of the auxiliary lamp and the headlamp can be executed separately.

DETAILED DESCRIPTION

Hereinafter, embodiments of the present invention will be described in detail with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
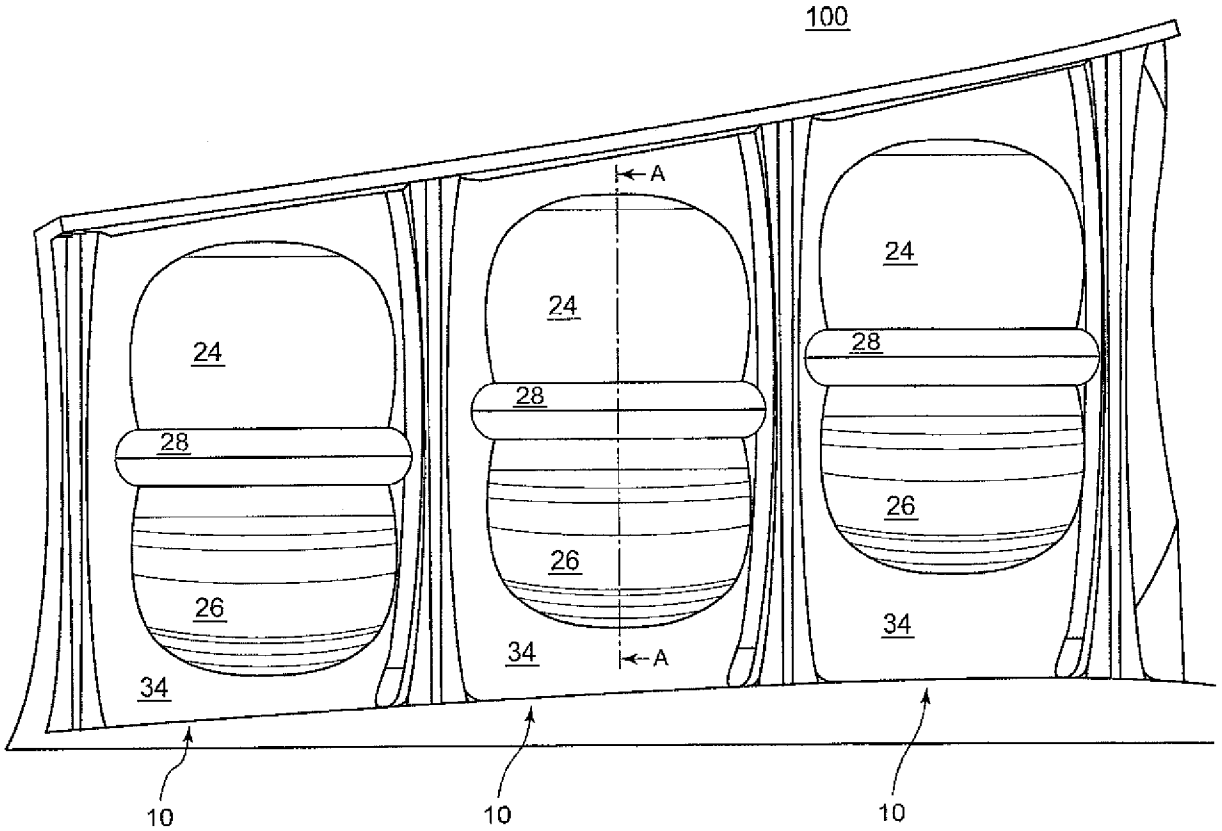
FIG. 1 is a front view of a headlamp unit into which vehicle headlamps according to a first embodiment of the invention are incorporated when a vehicle is seen from a front thereof.

FIG. 1 is a front view of a headlamp unit 100 into which vehicle headlamps according to a first embodiment of the invention are incorporated when a vehicle is seen from a front thereof. The headlamp unit 100 includes three vehicle headlamps 10. Each vehicle headlamp 10 has a DRL lens 24 and an HL lens 26 which are fitted in a cover 34. A shielding member 28 is disposed between the DRL lens 24 and the HL lens 26. The shielding member 28 shields an internal construction of the headlamp such as an auxiliary reflection member 16, which will be described later, from the outside so as to improve the external appearance of the vehicle headlamp when observed from the front of the vehicle.

As will be described later, the vehicle headlamp 10 includes a light source for a daytime running lamp (DRL) and a light source for a headlamp (HL) which are incorporated in a single unit. Then, by turning on either of the light sources, a luminous intensity distribution pattern for DRL or HL can be formed on an imaginary vertical aiming board which is disposed in a position which is 25 meters away from the front of the vehicle. In this embodiment, the luminous intensity distribution is controlled so that a low beam luminous intensity distribution pattern is formed when the HL light source is turned on. However, the luminous intensity distribution is controlled so that a different luminous intensity distribution pattern such as a high beam luminous intensity distribution pattern may be formed when the HL light source is turned on.

Figure 2:
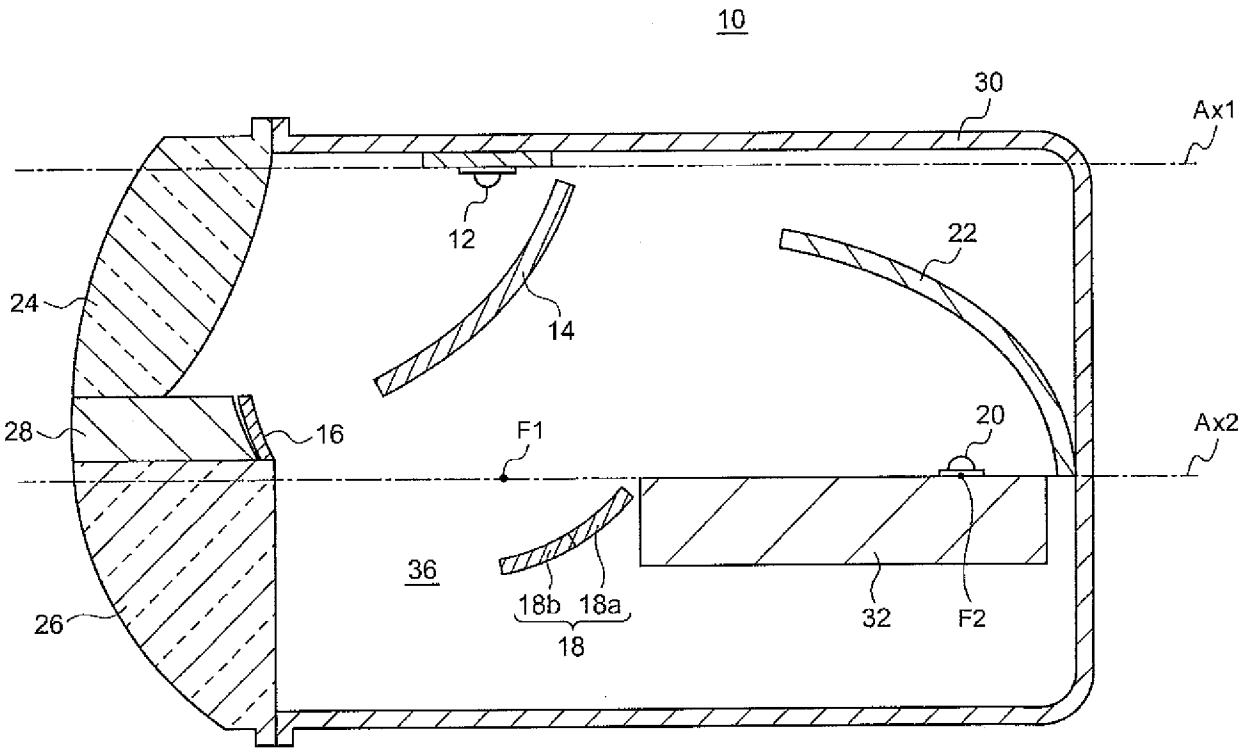
FIG. 2 is a schematic sectional view of the vehicle headlamp which is taken along the line A-A in FIG. 1.

FIG. 2 is a schematic sectional view of the vehicle headlamp 10 which is taken along a vertical plane including the line A-A in FIG. 1. A lamp compartment 36 is formed by a lamp body 30 which has a front opening and a DRL lens 24 and an HL lens 26 which are disposed so as to cover the front opening, and light sources and reflectors are disposed inside the lamp compartment 36.

The DRL lens 24 projects light emitted from a DRL light source 12 to the front of the vehicle. The DRL lens 24 is a diffusing lens which is designed for use for a DRL and which diffuses incident light vertically and horizontally.

The HL lens 26 is disposed adjacent downwardly to the DRL lens 24. The HL lens 26 has a rear focal point on a second optical axis Ax2 which extends in a front-to-rear direction of the vehicle. The HL lens 26 is made up of a planoconvex aspheric lens in which a front side surface is convex and projects a light source image formed on a rear focal plane to the front of the vehicle headlamp 10 as a reverted image.

The DRL light source 12 is disposed on a first optical axis Ax1 which extends parallel to the second optical axis Ax2 in the front-to-rear direction of the vehicle. Additionally, an HL light source 20 is disposed on the second optical axis Ax2 in a position lying further rearwards of the vehicle than the DRL light source 12. The HL light source 20 is disposed on a substrate 32 which functions not only as a heat dissipating plate but also as a shielding plate which eliminates unnecessary reflection light.

Although it is desirable that both the DRL light source 12 and the HL light source 20 are made up of a light emitting diode (LED), they may be made up of a halogen lamp or a discharge lamp. In the following description, the DRL light source 12 and the HL light source 20 will be described as each being made up of an LED. The DRL light source 12 and the HL light source 20 may each be made up of a single LED or a plurality of LEDs.

An HL reflector 22 reflects light emitted from the HL light source 20 towards the rear focal point of the HL lens. The HL reflector 22 has a reflection plane which is formed as a substantially ellipsoidal plane whose axis is constituted by the optical axis Ax2 on a light source side thereof. In the HL reflector 22, the reflection plane is designed so that the rear focal point of the HL lens 26 is situated near to a first focal point F1 of the ellipsoidal plane of the HL reflector 22 and the HL light source 20 is situated near to a second focal point F2 of the ellipsoidal plane.

A DRL reflector 14 is provided at the rear of the DRL light source 12. The DRL reflector 14 is provided as a separate configuration from the HL reflector 22. The DRL reflector 14 has a reflection plane which is formed as a substantially paraboloidal plane on a light source side thereof and reflects part of light emitted from the DRL light source 12 towards the DRL lens 24.

Of the light emitted from the DRL light source 12, part of the light which is not incident on the DRL reflector 14 is incident on an auxiliary reflection member 16. The auxiliary reflection member 16 is disposed at the rear of the shielding member 28 and has a substantially flat reflection plane to which for example, aluminum deposition is applied and which extends in a vertical direction to a surface of a sheet of paper on which FIG. 2 is drawn. The auxiliary reflection member 16 reflects light which is incident thereon towards a sub-reflector 18.

The sub-reflector 18 includes a DRL reflection plane 18*a* which is disposed in a position where the light reflected by the auxiliary reflection member 16 is reflected further towards the HL lens 26. However, the sub-reflector 18 is disposed further rearwards than the first focal point F1 of the HL reflector 22 so as to avoid the interference with light which is reflected towards the HL lens 26 by the HL reflector 22. The sub-reflector 18 may include an overhead sign (OHS) reflection plane 18*b* which illuminates an overhead road sign or signs above the road as a continuous plane with the DRL reflection plane 18*a*.

The sub-reflector 18 is formed as a parabolic cylinder which extends in the vertical direction to the surface of the sheet of paper on which FIG. 2 is drawn. In one or more embodiments of the present invention, a focal point of the parabola of the sub-reflector 18 is situated near to the rear focal point of the HL lens 26, that is, near to the first focal point F1 of the HL reflector 22. By so doing, reflection light reflected by the sub-reflector 18 is shone to an area lying near to the optical axis Ax1 of the HL lens 26, and therefore, an area lying near to the horizontal center line of the imaginary vertical aiming board can be illuminated brightly.

Figure 3A:
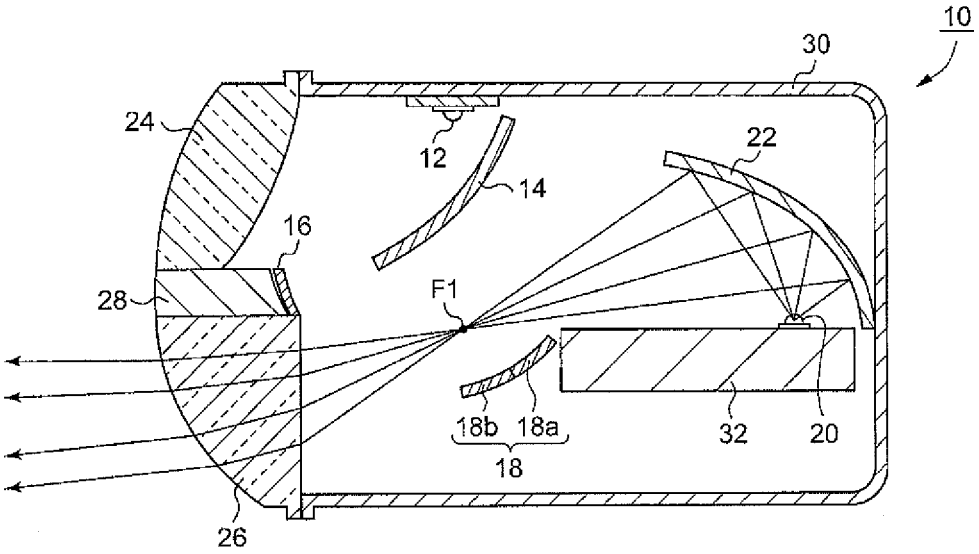
FIG. 3A is a light ray locus diagram which results when an HL light source is turned on in the vehicle headlamp shown in FIG. 2.
Figure 3B:
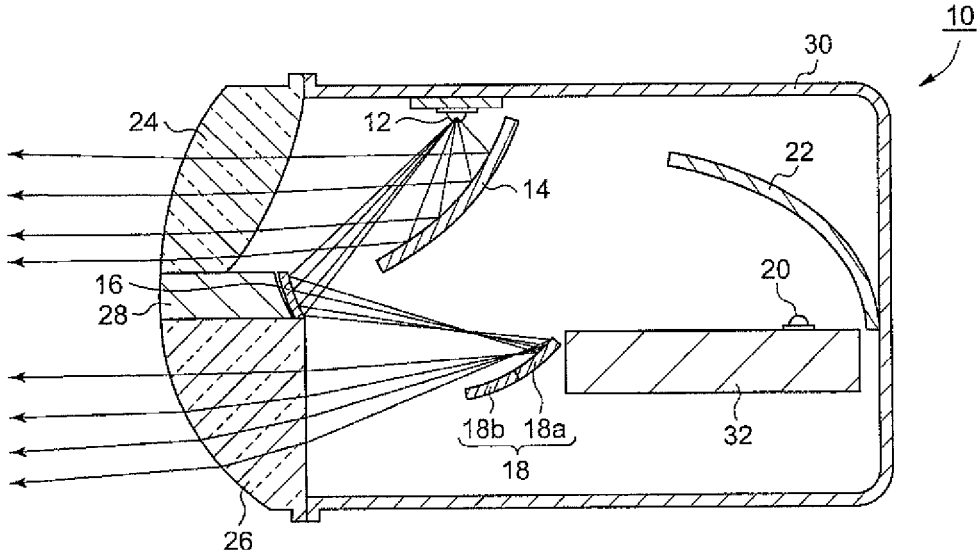
FIG. 3B is a light ray locus diagram which results when a DRL light source is turned on the vehicle headlamp shown in FIG. 2.

FIG. 3A shows a light ray locus diagram which results when the HL light source 20 is turned on in the vehicle headlamp 10, and FIG. 3B shows a light ray locus diagram which results when the DRL light source 12 is turned on the vehicle headlamp 10.

When the HL light source 20 is turned on, as shown in FIG. 3A, light emitted from the HL light source 20 is reflected by the HL reflector 22 and is then incident on the HL lens 26 to thereby form a low beam luminous intensity distribution pattern.

When the DRL light source 12 is turned on, as shown in FIG. 3B, most of light emitted from the DRL light source 12 is reflected by the DRL reflector 14 and is then incident on the DRL lens 24 to thereby form diffuse light which is suitable for the DRL. Of the light emitted from the DRL light source 12, the light that is not incident on the DRL reflector 14 is reflected by the auxiliary reflection member 16 and is thereafter reflected further by the sub-reflector 18 to thereby be incident on the HL lens 26. As a result, when the DRL light source 12 is turned on, the front of the vehicle can be illuminated by the light emitted from both the DRL lens 24 and the HL lens 26.

Thus, as has been described heretofore, in the vehicle headlamp according to first embodiment, the DRL light source and the HL light source are disposed in the same casing, while the optical system for directing light from the DRL light source towards the DRL lens and the optical system for directing light from the HL light source towards the HL lens are provided separately. Consequently, the luminous intensity distribution can be controlled individually for the DRL and the HL by designing the reflection planes of the reflectors therefor to match the objects of the DRL and the HL.

Additionally, light emitted from the DRL light source is shone to the front of the vehicle from both the DRL lens and the HL lens, and therefore, the light emitting surface resulting when the DRL light source is turned on can be expanded without using any additional light source, thereby making it possible to increase the chance where the subject vehicle is recognized by the driver of an oncoming vehicle or a pedestrian during daytime.

In addition, by providing the auxiliary reflection member which reflects part of light emitted from the DRL light source towards the sub-reflector, the amount of light which is guided to the HL lens can be increased more than when light is caused to reach the HL lens directly from the DRL light source.

Additionally, the two types of lamps having the different objects can be integrated into the single unit, and therefore, it is possible not only to realize a reduction in cost but also to save space.

Figure 4:
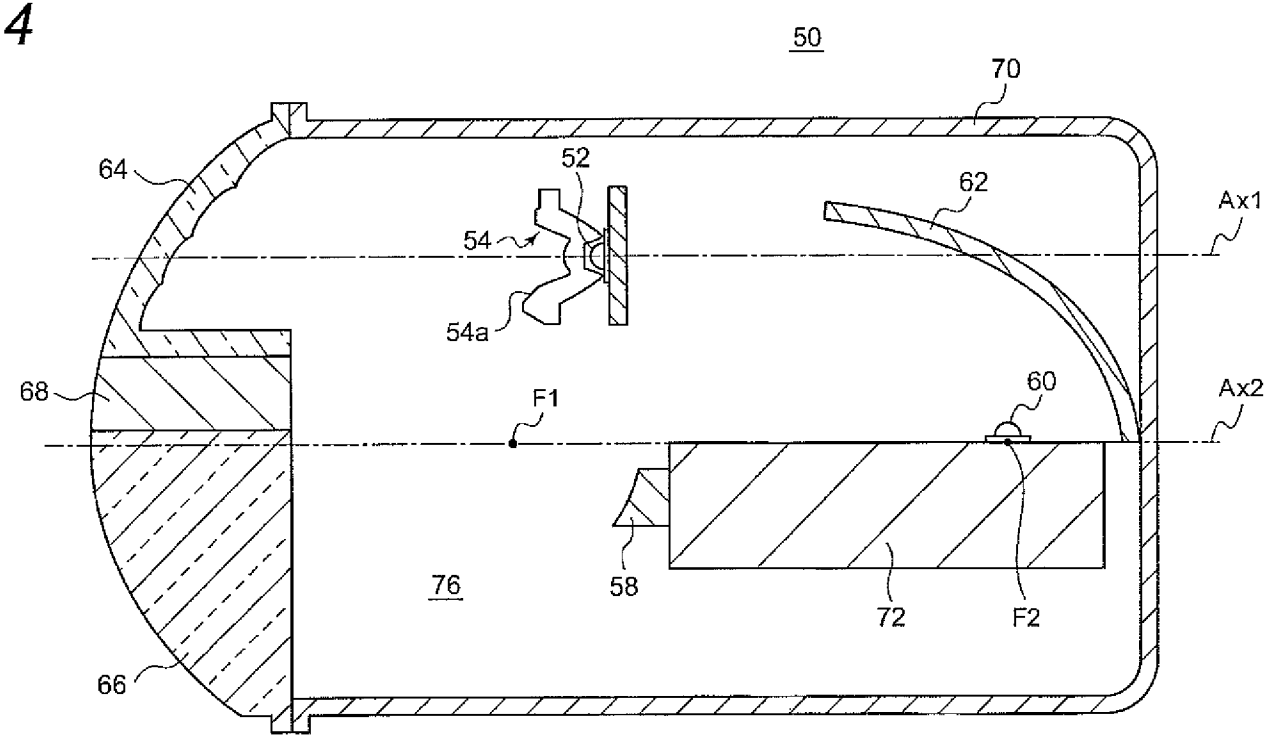
FIG. 4 is a schematic sectional view of a vehicle headlamp according to a second embodiment of the invention.

FIG. 4 is a schematic sectional view of a vehicle headlamp 50 according to a second embodiment of the present invention. FIG. 4 shows the same section as that shown in FIG. 2 which is taken along a vertical plane which includes optical axes of lenses. As with the first embodiment, a lamp compartment 76 is formed by a lamp body 70 which has a front opening and a DRL lens 64 and an HL lens 66 which are disposed so as to cover the front opening, and light sources and reflectors are disposed inside the lamp compartment 76. A shielding member 68 is disposed between the DRL lens 64 and the HL lens 66 for shielding an internal construction of the headlamp from the outside.

The DRL lens 64 projects light emitted from a DRL light source 52 to the front of the vehicle. The DRL lens 64 is a diffusing lens which is designed for use for a DRL and which diffuses incident light vertically and horizontally.

The HL lens 66 is disposed adjacent downwardly to the DRL lens 64. The HL lens 66 has a rear focal point on a second optical axis Ax2 which extends in a front-to-rear direction of the vehicle. The HL lens 66 is made up of a planoconvex aspheric lens in which a front side surface is convex and projects a light source image formed on a rear focal plane to the front of the vehicle headlamp 50 as a reverted image.

The DRL light source 52 is disposed on a first optical axis Ax1 which extends parallel to the second optical axis Ax2 in the front-to-rear direction of the vehicle. Additionally, an HL light source 60 is disposed on the second optical axis Ax2 in a position lying further rearwards of the vehicle than the DRL light source 52. The HL light source 60 is disposed on a substrate 72 which functions not only as a heat dissipating plate but also as a shielding plate which eliminates unnecessary reflection light. As with the first embodiment, it is desirable that both the DRL light source 52 and the HL light source 60 are made up of LEDs.

An HL reflector 62 reflects light emitted from the HL light source 60 towards the rear focal point of the HL lens 66. The HL reflector 62 has a reflection plane which is formed as a substantially ellipsoidal plane whose axis is constituted by the optical axis Ax2 on a light source side thereof. In the HL reflector 62, the reflection plane is designed so that the rear focal point of the HL lens 66 is situated near to a first focal point F1 of the ellipsoidal plane of the HL reflector 62 and the HL light source 60 is situated near to a second focal point F2 of the ellipsoidal plane.

A light guide member 54 is disposed between the DRL light source 12 and the DRL lens 64 for guiding light emitted from the DRL light source 12 towards the DRL lens 64. The light guide member 54 is formed of a transparent resin. Light that enters the light member 54 from an incident portion which faces the DRL light source 12 propagates inside the light guide member 54 through internal reflection and is emitted from a step formed on the light guide member 54 towards the DRL lens 64. The shape and number of steps that are formed on the light guide member 54 can control the luminous intensity distribution of light which is incident on the DRL lens 64.

A reflection plate 54*a* is formed on a lower side of the light guide member 54 for reflecting the light propagating in the interior of the light guide member towards a sub-reflector 58. The reflection plane 54*a* has a substantially flat shape and extends in a vertical direction to a surface of a sheet of paper on which FIG. 4 is drawn. The reflection plane 54*a* constitutes a member which corresponds to the auxiliary reflection member in the first embodiment.

The sub-reflector 58 is disposed in a position where light reflected by the reflection plate 54*a* of the light guide member 54 is reflected towards the HL lens 66. However, the sub-reflector 58 is disposed further rearwards than the first focal point F1 of the HL reflector 62 so as to avoid the interference with light that is reflected on the HL reflector 62 to travel towards the HL lens 66. The sub-reflector 58 is formed so as to have, for example, a substantially paraboloidal reflection plane. In one or more embodiments of the present invention, a focal point of a parabolic plane of the sub-reflector 58 is situated near to the rear focal point of the HL lens 66, that is, near to the first focal point F1 of the HL reflector 62. By so doing, reflection light reflected by the sub-reflector 58 is shone to an area lying near to the optical axis Ax2 of the HL lens 66, and therefore, an area lying near to the horizontal center line of the imaginary vertical aiming board can be illuminated brightly.

Figure 5A:
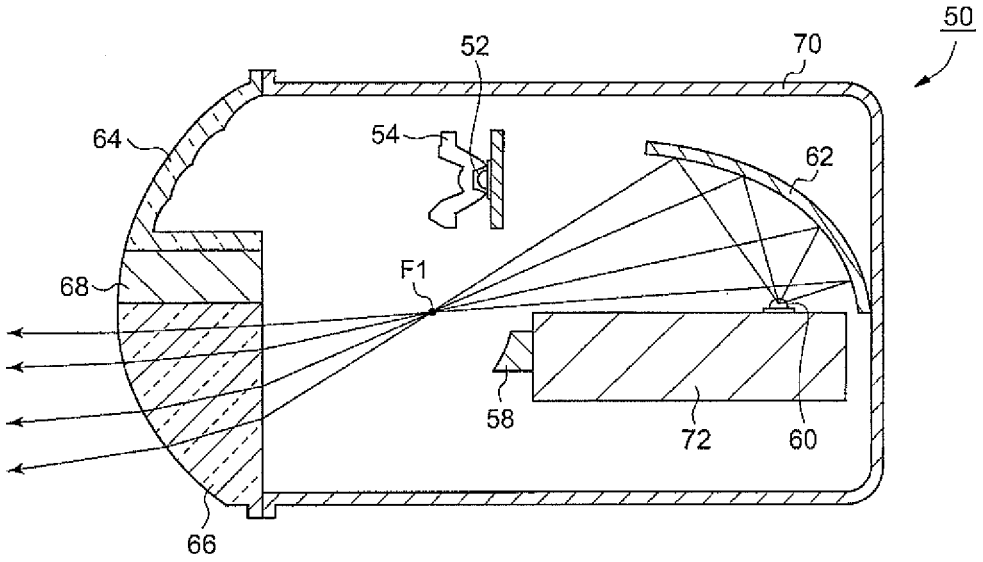
FIG. 5A is a light ray locus diagram which results when an HL light source is turned on in the vehicle headlamp shown in FIG. 4.
Figure 5B:
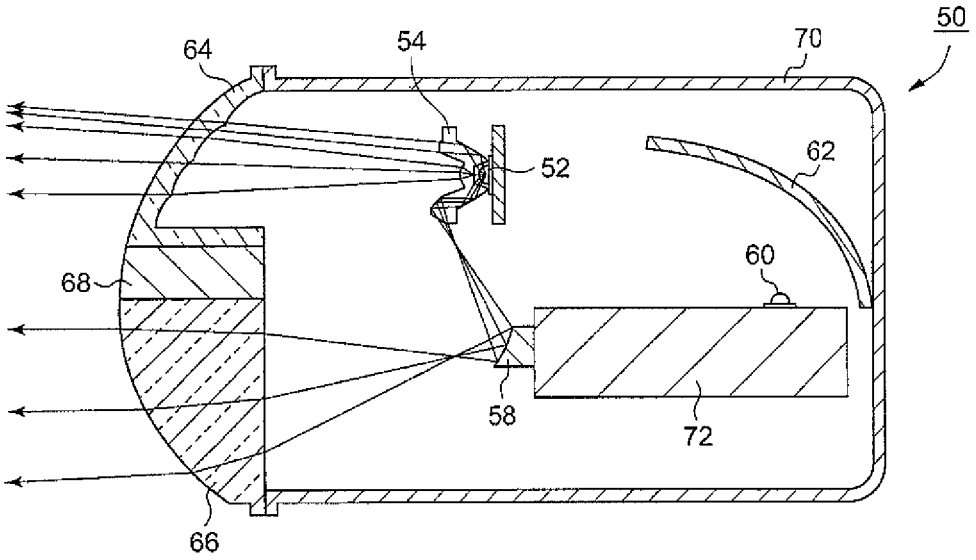
FIG. 5B is a light ray locus diagram which results when a DRL light source is turned on the vehicle headlamp shown in FIG. 4

FIG. 5A shows a light ray locus diagram which results when the HL light source is turned on in the vehicle headlamp 50, and FIG. 5B shows a light ray locus diagram which results when the DRL light source is turned on the vehicle headlamp 50.

When the HL light source 60 is turned on, as shown in FIG. 5A, light emitted from the HL light source 60 is reflected by the HL reflector 62 and is then incident on the HL lens 66 to thereby form a low beam luminous intensity distribution pattern.

When the DRL light source 52 is turned on, as shown in FIG. 5B, most of light emitted from the DRL light source 52 is propagated inside the light guide member 54 through internal reflection. Then, part of the light which is reflected inside the light guide member 54 is emitted towards the DRL lens 64 to thereby form diffuse light which is suitable for the DRL. The remaining of the light that is internally reflected inside the light guide member 54 is reflected by the reflection plane 54*a* of the light guide member 54 towards the sub-reflector 58 and is reflected further by the sub-reflector 58 towards the HL lens 66. As a result, as with the first embodiment, when the DRL light source 52 is turned on, light emitted from both the DRL lens 64 and the HL lens 66 can illuminate an area ahead of the vehicle.

Thus, as has been described heretofore, also, in the vehicle headlamp according to the second embodiment, the DRL light source and the HL light source are disposed in the same casing, while the optical system for directing light from the DRL light source towards the DRL lens and the optical system for directing light from the HL light source towards the HL lens are provided separately. Consequently, the luminous intensity distribution can be controlled individually for the DRL and the HL by designing the reflection planes of the reflectors therefor to match the objects of the DRL and the HL.

Additionally, light emitted from the DRL light source is shone to the front of the vehicle from both the DRL lens and the HL lens, and therefore, the light emitting surface resulting when the DRL light source is turned on can be expanded without using any additional light source.

In addition, the two types of lamps having the different objects can be integrated into the single unit, and therefore, it is possible not only to realize a reduction in cost but also to save space.

The invention is not limited to the embodiments that have been described heretofore, and hence, various modifications including design changes can be made thereto based on the knowledge of those skilled in the art. The configurations shown in the drawings only illustrate one example, and hence, the configurations can be changed that may obtain similar functions and may obtain similar advantages.

As to the shapes of the auxiliary reflection member 16 and the sub-reflector 18 and the reflection plate 54*a* and the sub-reflector 58, in addition to the configurations described in the above embodiments, various combinations are possible. For example, the auxiliary reflection member 16 or the reflection plane Ma may be formed into an elliptical cylinder, while the sub-reflector 18 or 58 may be formed into a flat plane. Alternatively, the auxiliary reflection member 16 or the reflection play 54*a* may be formed into an elliptical cylinder, while the sub-reflector 18 or 58 may be formed into an elliptical cylinder.

In the above embodiments, while the DRL lens and the HL lens are described as being configured as the separate members, a configuration may be adopted in which both the DRL lens and the HL lens are integrated into one unit.

In the above embodiments, while the DRL and the HL are described as constituting together the single vehicle headlamp, the light source of the DRL may be used as a light source of a CLL. In this case, it is desirable that the DRL reflector and the sub-reflector are designed so as to realize a luminous intensity distribution suitable for the CLL.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A vehicle headlamp comprising:

a first light source disposed on a first optical axis that extends in a front-to-rear direction of a vehicle;

a first lens that projects light emitted from the first light source to a front of the vehicle;

a second lens having a rear focal point on a second optical axis that is parallel to the first optical axis and disposed adjacent to the first lens;

a second light source disposed on the second optical axis rearwards of the first light source;

a reflector that reflects light emitted from the second light source towards the rear focal point of the second lens; and a sub-reflector disposed such that the sub-reflector does not interfere with an optical path which extends from the reflector to the second lens and that causes part of light emitted from the first light source to be incident on the second lens.

2. The vehicle headlamp as set forth in claim 1, wherein the sub-reflector is disposed near the rear focal point of the second lens.

3. The vehicle headlamp as set forth in claim 2, further comprising an auxiliary reflection member that reflects part of light emitted from the first light source towards the sub-reflector.

4. The vehicle headlamp as set forth in claim 3, further comprising a shielding member that conceals a gap defined between the first lens and the second lens.

* * * * *